US008196644B1

(12) United States Patent
Niske

(10) Patent No.: US 8,196,644 B1
(45) Date of Patent: Jun. 12, 2012

(54) ARRANGEMENT IN A TUBE HEAT EXCHANGER

(75) Inventor: Jörgen Niske, Limhamn (SE)

(73) Assignee: Tetra Laval Holdings & Finance SA, Pully (CH)

( * ) Notice: Subject to any disclaimer, the term of this patent is extended or adjusted under 35 U.S.C. 154(b) by 1058 days.

(21) Appl. No.: 10/111,597

(22) PCT Filed: Oct. 25, 2000

(86) PCT No.: PCT/SE00/02074

§ 371 (c)(1),
(2), (4) Date: Oct. 8, 2002

(87) PCT Pub. No.: WO01/31277

PCT Pub. Date: May 3, 2001

(30) Foreign Application Priority Data

Oct. 26, 1999 (SE) ..... 9903851

(51) Int. Cl.
*F28F 9/02* (2006.01)

(52) U.S. Cl. ..... 165/81; 165/82; 165/145; 165/158

(58) Field of Classification Search ..... 165/81, 165/82, 83, 145, 158
See application file for complete search history.

(56) References Cited

U.S. PATENT DOCUMENTS

| | | | | |
|---|---|---|---|---|
| 1,626,772 A | * | 5/1927 | Worden | 165/83 |
| 2,780,446 A | | 2/1957 | Huet | |
| 3,973,621 A | | 8/1976 | Bow et al. | |
| 4,676,303 A | * | 6/1987 | Barroyer et al. | 165/82 |
| 5,586,599 A | | 12/1996 | Sjöström | |
| 5,971,064 A | | 10/1999 | Palm | |

FOREIGN PATENT DOCUMENTS

| | | | |
|---|---|---|---|
| DE | 1948407 | | 4/1971 |
| DE | 2419780 | A1 | 9/1975 |
| DE | 3143088 | A1 * | 5/1983 |
| EP | 0128452 | A1 | 12/1984 |
| EP | 0151262 | A2 | 8/1985 |
| EP | 0393221 | A1 | 10/1990 |
| FR | 1537988 | | 7/1968 |
| FR | 2158130 | | 6/1973 |
| FR | 2371661 | | 6/1978 |
| FR | 2580762 | A1 | 10/1986 |
| JP | 51-67556 | A | 6/1976 |

(Continued)

OTHER PUBLICATIONS

English language translation of Japanese Office Action issued Apr. 20, 2010 by the Japanese Patent Office in Japanese Patent Application No. 2001-533377.

(Continued)

*Primary Examiner* — Leonard R Leo
(74) *Attorney, Agent, or Firm* — Buchanan Ingersoll & Rooney PC

(57) ABSTRACT

A heat exchanger comprising a large number of flexible individual elements, has supply and discharge devices for the heat exchanger media and also has, for these elements, tension devices which expand during heating. The tensioning of the individual elements, which are adhesively bonded at each of their two ends into slots of end plates, takes place by the application of the required forces to the end plates. A heat exchanger of this type is illustrated in FIG. 1.

20 Claims, 3 Drawing Sheets

FOREIGN PATENT DOCUMENTS

| | | | |
|---|---|---|---|
| JP | 54-60351 | U | 10/1977 |
| JP | 58-97478 | U | 7/1983 |
| JP | 63-109888 | U | 7/1988 |
| JP | 63-197993 | U | 12/1988 |
| SE | 501908 | | 6/1995 |

OTHER PUBLICATIONS

English language translation of Japanese Office Action issued Jan. 7, 2011 by the Japanese Patent Office in Japanese Patent Application No. 2001-533377.

* cited by examiner

ARRANGEMENT IN A TUBE HEAT EXCHANGER

FIELD OF THE INVENTION

The present invention relates to an arrangement in a tube heat exchanger of the type which has a number of heat transfer tubes surrounded by a casing tube and in which the heat transfer tubes are secured in tube plates at both of their ends.

BACKGROUND OF THE INVENTION

Heat exchangers, of which there are numerous types, are employed for heating or cooling a liquid product. With the aid of, for example, steam or water at different temperatures, it is possible to impart to the product a desired temperature. Heat exchangers come into use within many various processing industries and also commonly occur in food processing plants such as dairies or juice factories.

One well-known type of heat exchanger is the so-called tube heat exchanger. This consists of one or more heat exchanger elements which are interconnected to form a flow system. The heat exchanger elements comprise one or more heat transfer tubes surrounded by an outer jacket or casing tube. The heat transfer tubes are interconnected to form product inserts which in turn are interconnected by means of product pipe bends intended to circulate the product which is to be heated or cooled, depending on what process the heat exchanger is employed for. The heat transfer tubes are enclosed in a jacket or casing tube which also encloses the thermal transfer medium. Mutually adjacent casing tubes are interconnected to circulate the thermal transfer medium. The thermal transfer medium may consist of water at different temperatures, steam or other types of liquids or gases. One such heat exchanger is described in Swedish Patent Specification SE-501 908.

In order to increase the degree of efficiency of the heat exchanger, it is occasionally desirable to employ one or more heat exchanger elements as regenerative sections, i.e. the product which has been heated in the heat exchanger is caused to heat up the incoming, cold product. The incoming, cold product then consequently contributes in cooling the ready-treated, heated product. In order to employ an above-described tube heat exchanger regeneratively, product must be located in both the heat transfer tubes and in the casing tube which surrounds the heat transfer tubes. Such a process may considerably cheapen a complete tube heat exchanger and also reduce the energy consumption for the process which takes place in the tube heat exchanger.

The heat transfer tubes, enclosed in their casing tube, normally are of a length of approximately 6 m. In order that the tubes are not exposed to unnecessary stresses from vibrations or sagging, they must be supported at one or commonly more points along their length. If the heat transfer tubes sag or vibrate so that they touch one another, thermal transfer surface area is lost and the tube heat exchanger will not be as efficient as may be expected. Shorter tube lengths must also most generally be supported. The support points which are employed may be of various designs and forms and are most generally designated—employing a common name—so-called baffles. When only water or steam is employed as the thermal transfer medium, few or no requirements are placed on the form and design of these baffles, apart from the fact that they are to separate the heat transfer tubes from one another and prevent the heat transfer tubes from coming into contact with the inner wall of the casing tube.

When it is desired to employ a heat exchanger element regeneratively, utterly different requirements are immediately placed on a hygienic design with full washing capability. In those cases when the product contains fibres or small particles, such as fruit juices, these requirements are even more stringent. Attempts have been made to design the baffles so as to have as rounded-off surfaces as possible in order to avoid the risk that the fibres or particles of the product become accumulated. However, in practice it has proved difficult to obtain such a design of the baffles. Problems have also been encountered in causing the baffles to surround the heat transfer tubes without pockets being formed. All baffles entail more or less that something is located at right angles to the direction of flow of the product and, as a result, there is also always a risk of the accumulation of particles or fibres which may jeopardise the cleaning operation and ultimately give rise to production disruptions.

SUMMARY OF THE INVENTION

One object of the present invention is to realise an arrangement which keeps the heat transfer tubes separated from one another and the inner wall of the casing tube without constituting an obstruction for the product flowing on in the casing tube.

This and other objects have been attained according to the present invention in that the arrangement of the type described by way of introduction has been given the characterising feature that an axial force F is applied at least one end of the heat transfer tubes.

Preferred embodiments of the present invention have further been given the characterising features as set forth in the appended subclaims.

BRIEF DESCRIPTION OF THE DRAWINGS

One preferred embodiment of the present invention will now be described in greater detail hereinbelow, with reference to the accompanying Drawings, in which.

DETAILED DESCRIPTION OF THE INVENTION

Figure 1:
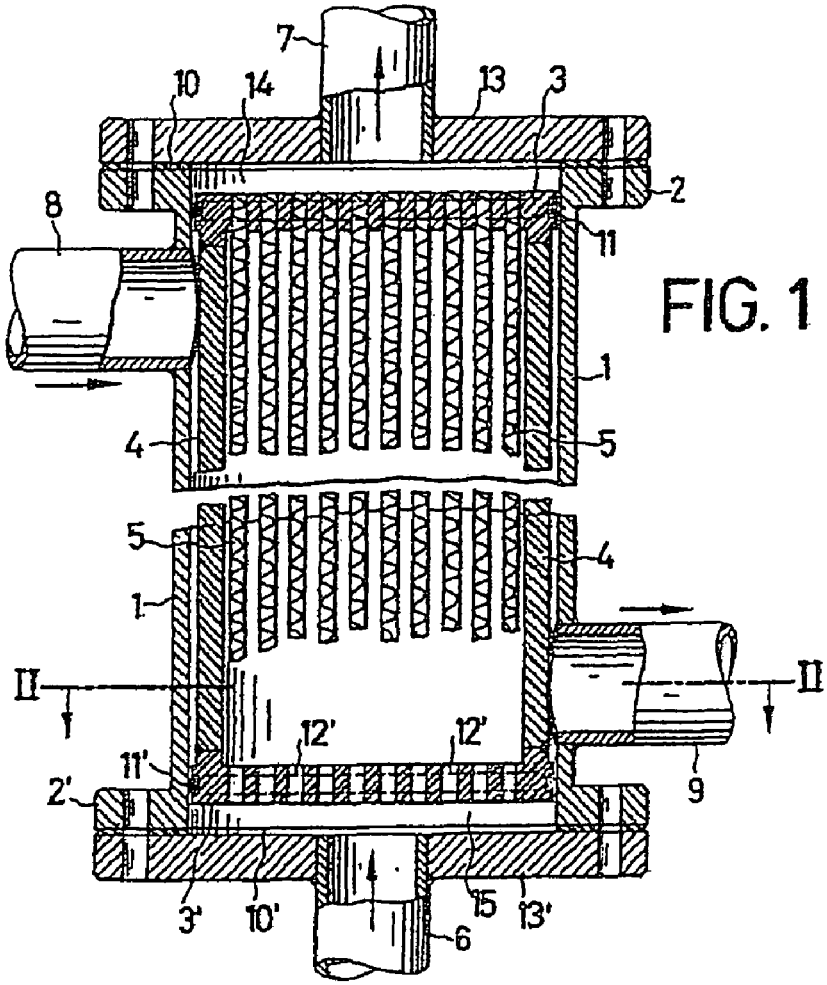
FIG. 1 shows, in side elevation and partly in section, a tube heat exchanger with an arrangement according to the present invention.
Figure 2:
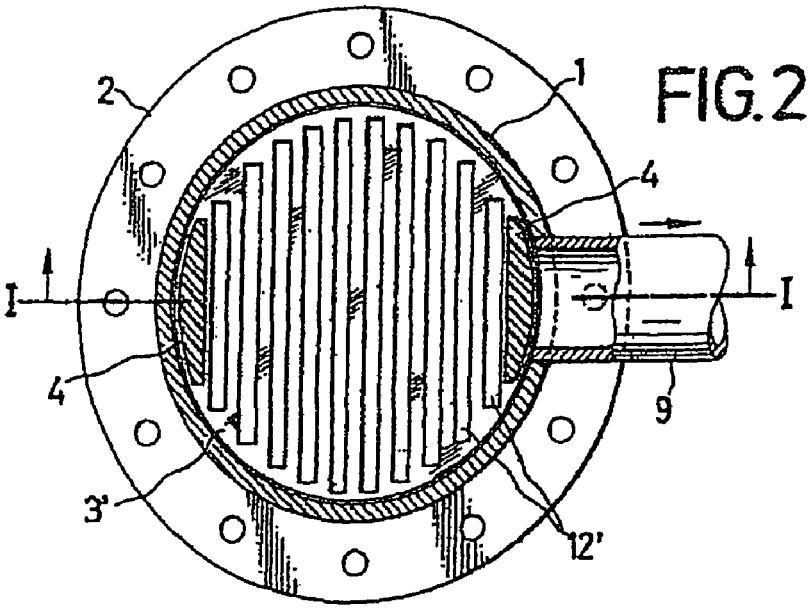
FIG. 2 shows, in side elevation and partly in section, a part of the arrangement according to the present invention.
Figure 3:
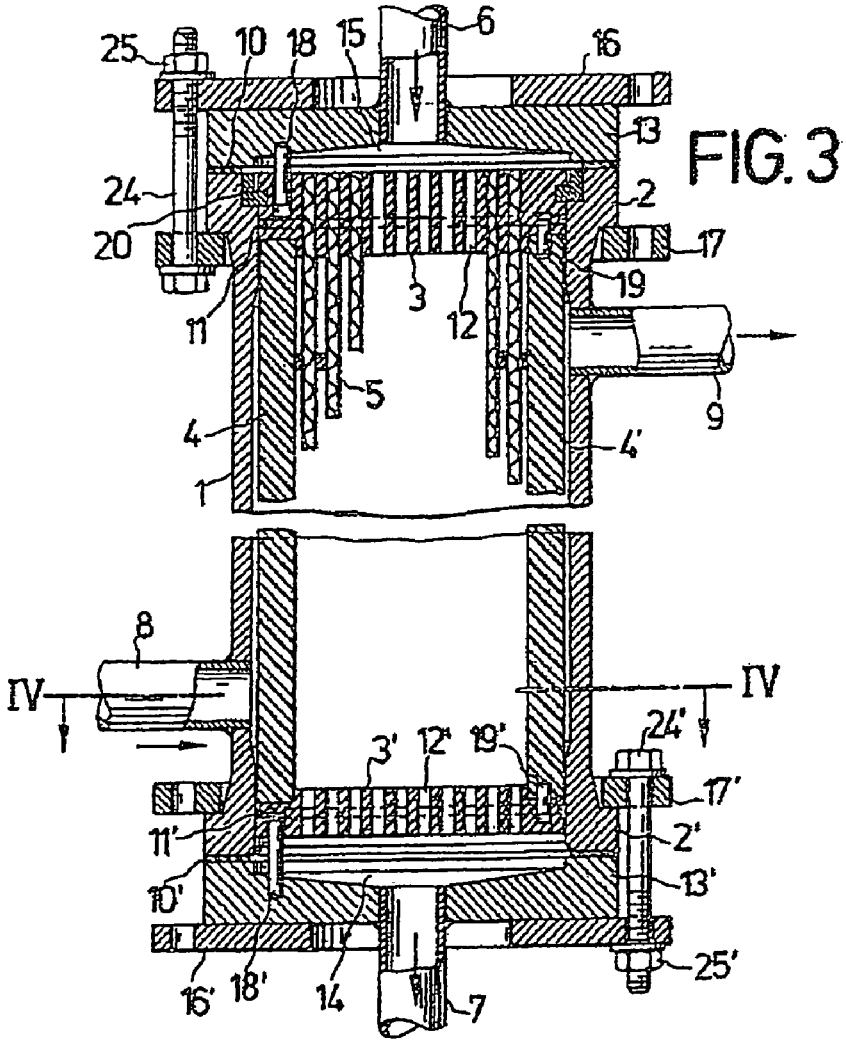
Figure 4:
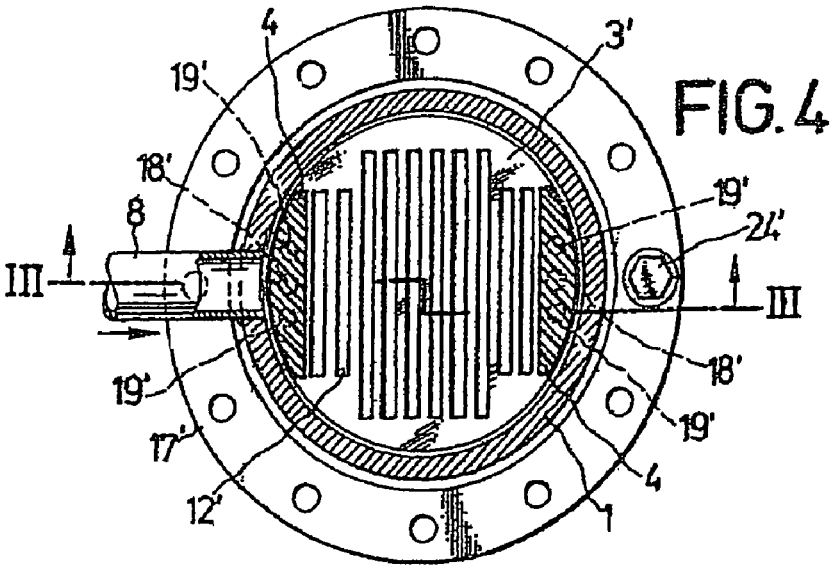
Figure 5:
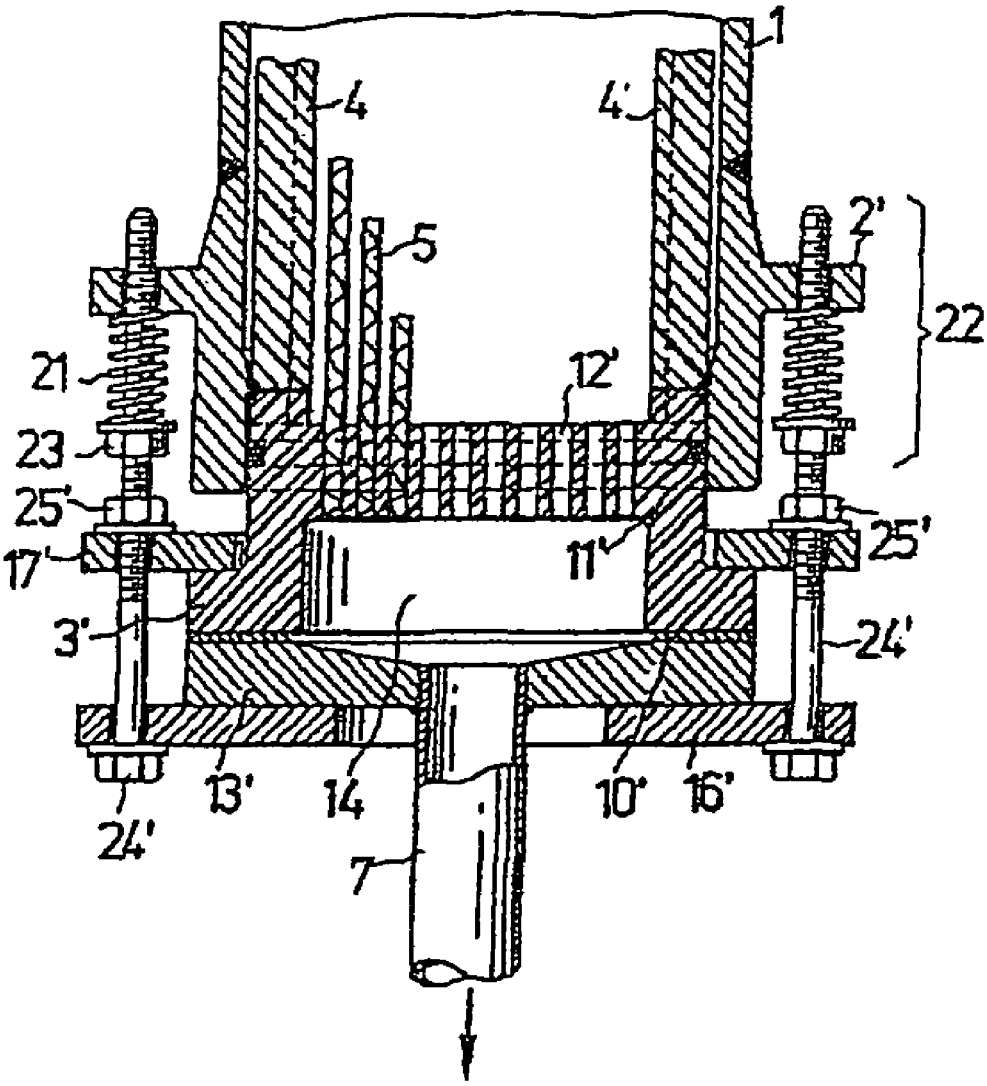

A tube heat exchanger 1 together with which the arrangement according to the present invention may be employed is shown in FIG. 1. The tube heat exchanger 1 consists of one or more heat exchanger elements 2 of which two are shown in FIG. 1. The heat exchanger elements 2 are interconnected for the formation of two flow systems. A heat exchanger element 2 consists substantially of a number of heat transfer tubes 3 which are enclosed in a casing tube 4.

The heat transfer tubes 3 are secured in both ends in tube plates 5 so that the heat transfer tubes 3 and the tube plates 5 constitute a flow insert 6. Two adjacent flow inserts 6 are interconnected by means of pipe bends 14 into a first flow system. This first flow system is employed in conventional heat exchangers 1 for one product.

The casing tubes 4 surrounding the heat transfer tubes 3 are in turn interconnected so that two adjacent casing tubes 4 are interconnected radially with one another by means of a socket tube 7 on each casing tube 4, or possibly by the intermediary of an intermediate connecting piece. The interconnected casing tubes 4 constitute a second flow system which, in conventional tube heat exchangers 1, is employed for a thermal transfer medium.

Most tube heat exchangers occurring on the market have heat exchanger elements 2 which are of a length of approximately 6 meters. If the heat transfer tubes 3 and the casing tube 4 are not supported along this length, the tubes 3 and 4 will sag because of gravity. The heat transfer tubes 3 will touch one another and the inner wall of the casing tube 4. In order to avoid this, conventional tube heat exchangers 1 call for the supporting of the heat transfer tubes 3 by means of so-called baffles of various designs. The function of the baffles has been proven and they function satisfactorily when the first flow system is employed for a product and the second for a thermal transfer medium.

When it is intended to employ the tube heat exchanger 1 regeneratively, both the first and the second flow systems will contain product. The one flow system contains cold product entering the tube heat exchanger 1 and the other system contains ready-treated, heated product, or vice versa. This implies at the same time that totally different requirements are placed on the support of the heat transfer tubes 3.

Modern tube heat exchangers 1 normally have so-called floating ends, i.e. the tube plates 5 are, to some extent, movable in relation to the casing tubes 4 in order to compensate for the thermal expansion which occurs in the tube heat exchanger 1. In the arrangement according to the present invention, the one end of the heat transfer tubes 3 is fixed in that the tube plate 5' is held fast against one end 8 of the casing tube 4. At the other end of the heat transfer tubes 3, the tube plate 5" is movable and there is disposed a spring battery 9 between the tube plate 5" and the casing tube 4. The arrangement according to the present invention may thus, with very slight modifications, be retroactively employed on extant tube heat exchangers 1 with floating ends. The arrangement is also usable for other types of tube ends for which, however, a minor retrofitting may be required.

The spring battery 9 consists, in the preferred embodiment of the arrangement according to the present invention, of a number of plate springs 10 placed between two plates 11, 12. The plates 11, 12 are united by means of through-going, bolts (not shown) in order to facilitate assembly and dismantling of the spring battery 9. The bolts serve no function while the spring battery 9 is mounted on the tube heat exchanger 1. The spring battery 9 may also consist of other types of springs, such as helical springs. The spring battery 9, with its plate springs 10, also affords the possibility of compensating for the thermal expansion of the heat exchanger element 2. Alternatively, the force F may be realised exclusively by means of bolts which are tightened to the desired degree. However, this alternative affords no possibility of compensating for the thermal movements of the heat exchanger element 2.

The spring battery 9 gives a certain predetermined force F. The force is determined by the number of plate springs 10 and their dimension over a given distance L. The force F is thus applied axially on a flow insert 6. That force F which is applied must be sufficient to keep the heat transfer tubes 3 taut so that they do not touch each other or brush against the inner wall of the casing tube 4. In the preferred embodiment, the force F is applied by means of the spring battery 9 in the one end of the heat transfer tubes 3. Alternatively, the force F may be distributed so that the spring battery 9 is mounted in both ends of the heat transfer tubes 3.

An excessively great force F would entail unnecessary stresses in the anchorages of the heat transfer tubes 3 in the tube plates 5, and too slight a force F would entail that the heat transfer tubes 3 are not held apart in the desired manner. An overly great force might also result in undesirable "catapult effects" on assembly and dismantling, and thereby occasion a risk of personal injury. The force F which is required depends upon the natural weight of the heat transfer tubes 3, i.e. dimensions and material thickness. Calculations have shown that many tube heat exchangers 1 occurring on the market have heat transfer tubes 3 which require a force of approximately 1,000 N per heat transfer tube 3 in order that these be kept in the taut state at a normal tube length of 6 meters.

In a conventional tube heat exchanger 1, the long tube lengths also occasion a certain sagging of the casing tube 4. This is normally compensated for by employing a centre support 13. However, the preferred embodiment permits a certain sagging of the casing tube 4 and the force F which is applied per heat transfer tube 3 can thus be reduced to that state where there is no contact between the heat transfer tubes 3 and casing tube 4. Any possible centre support 13 on the tube heat exchanger element 2 will be adapted to the sagging, if any.

An above-described arrangement according to the present invention thus realises a tube heat exchanger I where no so-called baffles are required to keep the heat transfer tubes 3 apart from one another and apart from the inner wall of the casing tube 4. This affords a free passage of liquid in the casing tube 4 and, in those cases where it is desirable to employ the tube heat exchanger 1 regeneratively, there is nothing to prevent the product from moving around and between the heat transfer tubes 3. In particular for products which contain particles or fibres, such as fruit juices or the like, the arrangement according to the present invention affords a possibility of employing the tube heat exchanger 1 regeneratively without the risk that the fibres accumulate on the obstructing surfaces which the baffles constitute. The arrangement according to the present invention also affords full washing capability in both flow systems of the tube heat exchanger 1.

As will have been apparent from the foregoing description, the present invention realises an arrangement which permits the use of a tube heat exchanger regeneratively without baffles constituting obstacles in the direction of flow of the product. The absence of baffles also makes it possible for so-called 'difficult products', i.e. products containing fibres or particles, to utilize the tube heat exchanger receneratively.

The present invention should not be considered as restricted to that described above and shown on the Drawings, many modifications being conceivable without departing from the scope of the appended Claims.

What is claimed is:

1. A tube heat exchanger comprising:

a number of heat transfer tubes surrounded by a casing tube and in which the heat transfer tubes are secured in tube plates at both of their ends, at least one of said tube plates being movable in relation to said casing tube while said casing tube is stationary; and means for applying an axial tensile force F to said at least one tube plate without being constrained by an expansion joint, with said axial tensile force F being sufficient to keep said heat transfer tubes taut and separated from each other without application of an additional axial tensile force, wherein said means comprises a spring battery.

2. The tube heat exchanger as claimed in claim 1, wherein the spring battery consists of a number of plate springs.

3. The tube heat exchanger as claimed in claim 1, wherein the force F is approximately 1,000 N per heat transfer tube.

4. The tube heat exchanger as claimed in claim 1, wherein one of said tube plates is fixed against one end of said casing tube.

5. The tube heat exchanger as claimed in claim 4, wherein said spring battery is disposed on an outer surface of said casing tube between said casing tube and the movable tube plate.

6. The tube heat exchanger as claimed in claim 5, wherein said spring battery includes plate springs disposed between first and second plates.

7. The tube heat exchanger as claimed in claim 1, wherein said axial tensile force F is sufficient to keep said heat transfer tubes apart from an inner wall of said casing tube without application of an additional axial tensile force.

8. The tube heat exchanger as claimed in claim 1, wherein said heat transfer tubes are arranged such that a liquid can pass freely in said casing tube around and between said heat transfer tubes.

9. The tube heat exchanger as claimed in claim 1, wherein the tube plates are not supported by a supporting device located between the tube plates.

10. The tube heat exchanger as claimed in claim 1, wherein said means applies the axial tensile force F to keep the heat transfer tubes taut and separated from each other and avoid sagging of the heat transfer tubes due to gravity.

11. The tube heat exchanger as claimed as claim 1, wherein the heat transfer tubes have a length of about 6 meters and are cylindrical shaped.

12. A tube heat exchanger comprising:

heat transfer tubes surrounded by a casing tube and in which the heat transfer tubes are secured in tube plates at both of their ends, at least one of the tube plates being movable in relation to the casing tube while the casing tube is stationary, the at least one movable tube plate received within the casing tube; and means for exclusively applying an axial tensile force F to the at least one movable tube plate, with the axial tensile force F being sufficient to keep the heat transfer tubes taut and separated from each other, wherein the means comprises a spring battery.

13. The tube heat exchanger as claimed in claim 12, wherein one of the tube plates is fixed against one end of the casing tube.

14. The tube heat exchanger as claimed in claim 12, wherein the means applies the axial tensile force F to keep the heat transfer tubes taut and separated from each other and avoid sagging of the heat transfer tubes due to gravity.

15. A tube heat exchanger comprising:

heat transfer tubes surrounded by a casing tube and in which the heat transfer tubes are secured in tube plates at both of their ends, at least one of the tube plates is received within the casing tube and movable in relation to the casing tube, the at least one movable tube plate being disposed at an open end of the casing tube; and means for applying an axial tensile force F to the at least one movable tube plate, with the axial tensile force F being sufficient to keep the heat transfer tubes taut and separated from each other, wherein the means comprises a spring battery;

wherein the tube heat exchanger comprises no baffle between the heat transfer tubes and an inner wall of the casing tube such that a liquid can pass freely in the casing tube between the heat transfer tubes and around the heat transfer tubes in a space located between the heat transfer tubes and the inner wall of the casing tube, the space extending axially between the tube plates.

16. The tube heat exchanger as claimed in claim 15, wherein one of the tube plates is fixed against one end of the casing tube.

17. The tube heat exchanger as claimed in claim 16, wherein the at least one movable tube plate is received within the casing tube.

18. The tube heat exchanger as claimed in claim 15, wherein the at least one movable tube plate is movable in relation to the casing tube while the casing tube is stationary.

19. The tube heat exchanger as claimed in claim 15, wherein the spring battery applies the axial tensile force F to the at least one movable tube plate without being constrained by an expansion joint.

20. The tube heat exchanger as claimed in claim 15, wherein the means applies the axial tensile force F to keep the heat transfer tubes taut and separated from each other and avoid sagging of the heat transfer tubes due to gravity.

* * * * *